US010718096B2

(12) United States Patent
Li et al.

(10) Patent No.: US 10,718,096 B2
(45) Date of Patent: Jul. 21, 2020

(54) THREE-DIMENSIONAL DRAINAGE DEVICE SUITABLE FOR LOOSE FILLING SLOPE AND METHODS FOR CONSTRUCTING THREE-DIMENSIONAL DRAINAGE DEVICE

(71) Applicant: CHINA UNIVERSITY OF GEOSCIENCES (WUHAN), Wuhan (CN)

(72) Inventors: Changdong Li, Wuhan (CN); Huiming Tang, Wuhan (CN); Mingjuan Wu, Wuhan (CN); Junrong Zhang, Wuhan (CN); Yongquan Zhang, Wuhan (CN); Lei Huang, Wuhan (CN)

(73) Assignee: CHINA UNIVERSITY OF GEOSCIENCES (WUHAN), Wuhan (CN)

( * ) Notice: Subject to any disclaimer, the term of this patent is extended or adjusted under 35 U.S.C. 154(b) by 0 days.

(21) Appl. No.: 16/382,239

(22) Filed: Apr. 12, 2019

(65) Prior Publication Data

US 2020/0080273 A1 Mar. 12, 2020

(30) Foreign Application Priority Data

Sep. 7, 2018 (CN) ..... 2018 1 1044782

(51) Int. Cl.
*E02D 17/20* (2006.01)
*E02D 29/02* (2006.01)

(52) U.S. Cl.
CPC ..... *E02D 17/205* (2013.01); *E02D 29/0208* (2013.01); *E02D 29/0266* (2013.01); *E02D 2600/20* (2013.01); *E02D 2600/40* (2013.01)

(58) Field of Classification Search
CPC ..... E02D 17/205; E02D 29/0266; E02D 29/0208; E02D 2600/20; E02D 2600/40
USPC ..... 405/36–51, 129.57–129.85
See application file for complete search history.

(56) References Cited

U.S. PATENT DOCUMENTS 710,813 A * 10/1902 Staneart ..... E02B 5/005 405/119
746,242 A * 12/1903 Baggaley ..... F03B 13/142 60/398
973,442 A * 10/1910 Lees ..... E03F 3/046 405/118
1,878,295 A * 9/1932 Richmond ..... E02B 3/18 405/36

(Continued)

*Primary Examiner* — Benjamin F Fiorello
*Assistant Examiner* — Edwin J Toledo-Duran
(74) *Attorney, Agent, or Firm* — Hemisphere Law, PLLC; Zhigang Ma

(57) ABSTRACT

The present disclosure relates to a three-dimensional drainage device suitable for a loose filling slope and methods for constructing the three-dimensional drainage device. The slope includes a stable stratum and a filling soil stratum above the stable stratum. The three-dimensional drainage device includes a surface drainage mechanism, a shallow drainage mechanism and a deep drainage mechanism. The surface drainage mechanism includes one or more catchment canals arranged on an upper surface of the filling soil stratum and a pool arranged on an edge of the filling soil stratum. The shallow drainage mechanism includes one or more first collecting pipes. The deep drainage mechanism includes one or more drainage gabions and one or more second collecting pipes.

18 Claims, 7 Drawing Sheets

(56) References Cited

U.S. PATENT DOCUMENTS 1,986,383 A * 1/1935 Usinger ..... E04D 13/064 405/120
2,148,773 A * 2/1939 Ozias ..... 404/2
2,628,056 A * 2/1953 Fuller ..... F16K 3/10 251/147
2,653,449 A * 9/1953 Stauch ..... A01G 25/06 405/45
3,140,720 A * 7/1964 Griswold ..... G04C 23/34 137/59
3,331,207 A * 7/1967 McGrew ..... E02B 13/00 405/39
3,380,254 A * 4/1968 Rossi ..... E02B 3/12 405/270
3,441,316 A * 4/1969 Hannifan ..... E21C 41/16 299/5
3,479,825 A * 11/1969 Hellstrom ..... E02B 13/00 405/38
3,701,260 A * 10/1972 Soileau ..... E02B 8/06 405/40
3,849,991 A * 11/1974 Niederwemmer ..... E02B 13/00 405/38
3,898,778 A * 8/1975 Erickson ..... E01C 11/227 404/2
3,910,500 A * 10/1975 Hardison ..... A01G 25/02 239/310
4,523,875 A * 6/1985 DiFiore ..... E02B 11/00 210/446
4,525,172 A * 6/1985 Eriksson ..... C10F 5/00 110/263
4,561,801 A * 12/1985 Nantz ..... E02B 5/00 405/118
4,678,375 A * 7/1987 Gagle ..... E02D 5/80 405/129.7
4,685,828 A * 8/1987 Whittle ..... E02B 13/02 251/147
5,092,709 A * 3/1992 Davis ..... E02B 11/00 405/129.7
5,510,038 A * 4/1996 Wegmuller ..... C02F 5/10 210/696
5,599,139 A * 2/1997 Chewning ..... B09B 1/00 405/129.6
6,379,543 B1 * 4/2002 Bowman ..... B01D 24/007 210/170.03
6,626,609 B1 * 9/2003 Kotani ..... E02D 31/004 405/53
6,698,977 B1 * 3/2004 Charon ..... E02B 5/02 210/170.1
7,497,234 B2 * 3/2009 Robinson ..... E03F 1/00 138/44
8,109,047 B2 * 2/2012 Dana ..... C10G 33/00 299/14
2001/0002968 A1 * 6/2001 Black ..... E03F 1/002 405/36
2003/0118403 A1 * 6/2003 Wilkerson ..... E02B 11/00 405/36
2005/0042030 A1 * 2/2005 Fu ..... E03F 5/046 405/36
2005/0271473 A1 * 12/2005 Charon ..... E01C 11/223 405/121
2006/0002763 A1 * 1/2006 Schafer ..... E02B 11/00 405/43
2006/0072970 A1 * 4/2006 Charon ..... E02B 5/02 405/118
2006/0222458 A1 * 10/2006 Grimes ..... E01C 11/223 404/2
2009/0324346 A1 * 12/2009 Milton ..... E02D 17/20 405/284
2010/0086356 A1 * 4/2010 Hopf ..... E02B 3/04 405/36
2012/0230767 A1 * 9/2012 desGarennes ..... E02B 11/005 405/45
2013/0048630 A1 * 2/2013 Zajicek ..... B29C 66/4722 220/4.13
2014/0042064 A1 * 2/2014 Byeon ..... C02F 3/327 210/170.01
2014/0348591 A1 * 11/2014 Hamman ..... F16L 1/028 405/184.3
2015/0191877 A1 * 7/2015 Aboulcaid ..... E01D 21/00 404/1
2016/0017587 A1 * 1/2016 He ..... E03B 3/02 210/170.03
2016/0073596 A1 * 3/2016 Pals ..... E01C 3/06 405/42
2016/0101942 A1 * 4/2016 Hinchberger ..... B09B 1/008 405/129.75
2016/0102026 A1 * 4/2016 Hulls ..... C05F 3/00 71/9
2016/0143232 A1 * 5/2016 Keith ..... A01G 25/09 405/36
2016/0145129 A1 * 5/2016 Roess ..... C02F 3/106 210/232
2017/0241100 A1 * 8/2017 Turner ..... E02D 29/10
2018/0014476 A1 * 1/2018 Shah ..... A01G 24/00
2018/0201530 A1 * 7/2018 Greco ..... B01J 20/28042
2019/0169830 A1 * 6/2019 Jurgens ..... E21B 7/046

* cited by examiner

THREE-DIMENSIONAL DRAINAGE DEVICE SUITABLE FOR LOOSE FILLING SLOPE AND METHODS FOR CONSTRUCTING THREE-DIMENSIONAL DRAINAGE DEVICE

CROSS REFERENCE TO RELATED APPLICATION

This application claims the priority of Chinese Patent Application No. 201811044782.3, entitled "Three-dimensional Drainage Device Suitable for Loose Filling Slope and Methods for Constructing Three-dimensional Drainage Device", filed on Sep. 7, 2018, the disclosure of which is incorporated herein by reference in its entirety.

BACKGROUND OF THE INVENTION

1. Field of the Invention

The present invention relates to the field of slope drainage, and particularly to a three-dimensional drainage device suitable for a loose filling slope and methods for constructing three-dimensional drainage device.

2. Description of Related Art

Landslide is a kind of serious geohazards worldwide. With the increasing frequency of engineering activities, the landslide disaster is becoming more and more frequent, causing more and more losses. The loss caused by the instability of the artificial filling slope is very serious in landslide disaster. An important factor causing the landslide disaster is water. The landslide disasters caused by water occur every year. A large number of facts also prove that the effective drainage facilities of slopes are a very important and effective means for slope treatment engineering, especially for the loose filling slope with loose soil, complicated composition and the larger soil pores. Effective drainage can greatly enhance the stability of the slope and reduce its potential threats.

The shallow drainage is the most widely applied way in the current slope drainage, which can reduce the infiltration of the surface water to some extent, but it can't discharge the internal water seeping into the slope soil in a timely and effective manner. The hysteresis effect caused by the water such as rainfall on the slope cannot be well solved, and the drain hole is easy to collapse and clog, which reduces the drainage effect to a great extent. The deep drainage can discharge the water inside the slope to some extent, but it costs much and is difficult to be widely used.

In view of the above problems, the drainage design of the same slope generally adopts a method of combining multiple drainage designs. However, the combination of multiple drainage methods is not a simple superposition-method construction, which may lead to the increase of the construction cost, unreasonable allocation of resources and other problems. Therefore, it is of importance to design a systematic, economical and effective slope drainage scheme, which is rarely mentioned.

SUMMARY OF THE INVENTION

One aspect of the present disclosure relates to a three-dimensional drainage device suitable for a loose filling slope is provided. The slope includes a stable stratum and a filling soil stratum above the stable stratum, and bottom of the filling soil stratum is provided with a catchment ditch. The three-dimensional drainage device includes: a surface drainage mechanism, including one or more catchment canals arranged on an upper surface of the filling soil stratum and a pool arranged on an edge of the filling soil stratum and the pool is connected with the catchment ditch, wherein two ends of the catchment canal connect with the pool; one or more drainage canals are arranged between the two adjacent catchment canals, wherein the two ends of the drainage canal connect with the two catchment canals and at least one drainage canal is connected with the catchment ditch; a shallow drainage mechanism, including one or more first collecting pipes, at least one collecting pipe is arranged on an upper side of the catchment canal, wherein an upper end of the first collecting pipe is provided with a filter packet and is buried in the filling soil stratum, and a lower end of the first collecting pipe connects with the catchment canal; and a deep drainage mechanism, including one or more drainage gabions and one or more second collecting pipes, wherein the drainage gabions are arranged side by side on the upper surface of the stable stratum, wherein the upper end of the second collecting pipe connect with the catchment canal and the lower end of the second collecting pipe connects with the drainage gabion and at least one drainage gabion is connected with the catchment ditch.

In some embodiments, one side of the pool near the edge of the filling soil stratum is provided with one or more steps configured to weaken impact of water to the pool.

In some embodiments, each catchment canal is aligned along one contour of the slope and height differences between two adjacent contours are the same.

In some embodiments, a cross-section of the catchment canal is an inverted trapezoid.

In some embodiments, the catchment canals are distributed ladder-like along the upper surface of the filling soil stratum and the filling soil stratum is divided into several slope sections by the catchment canals.

In some embodiments, an upper edge of the slope section is provided with a platform configured to reinforce the catchment canal.

In some embodiments, the slope section is provided with one or more drainage canals and the slope section is divided into one or more ditch grids by the drainage canals.

In some embodiments, two ends of the drainage canal of the slope section are connected with the two catchment canals at the upper end and the lower end of the slope section respectively.

In some embodiments, the two ends of the drainage canal are vertically connected with the two catchment canals at the upper end and the lower end of the slope section respectively.

In some embodiments, the drainage canals of the lowest slope section are connected with the catchment ditch and water in the lowest slope section flow into the catchment ditch.

In some embodiments, cross-sectional areas of the catchment canals from high to low increase in turn, the cross-sectional areas of the drainage canals from high to low increase in turn and the cross-sectional areas of the pools from high to low increase in turn.

In some embodiments, the catchment canal is provided with a drain hole and the first collecting pipe is arranged in the drain hole.

In some embodiments, the first collecting pipe is wrapped with geotextile outside.

In some embodiments, the first collecting pipe includes an inner layer and an outer layer, the inner layer is a plastic-coated galvanized wire pipe and the outer layer is a PVC pipe.

In some embodiments, the first collecting pipe is divided into an upper half pipe and a lower half pipe along a center axis section of the first collecting pipe, the upper half pipe is permeable and the lower half pipe is impermeable.

In some embodiments, the second collecting pipe includes three pipe layers of a first layer, a second layer and a third layer in turn from inside to outside, the first layer is a PVC pipe, the second layer is a plastic-coated galvanized wire pipe and the third layer is a permeable PVC pipe.

In some embodiments, the drainage gabion includes a grouted rubble groove; the grouted rubble groove includes one or more ladder grooves, and the ladder grooves are connected with each other in turn; and a rectangular cage connected with the lower end of the second collecting pipe is placed in the ladder groove, and water in the drainage gabion flow into the catchment ditch.

In some embodiments, inner wall of the ladder groove is provided with a barrier coat, the rectangular cage is wrapped with geotextile outside and is filled with one or more stones, the rectangular cage is provided with one or more hooks, and two adjacent rectangular cages are connected with each other via the hooks.

Another aspect of the present disclosure relates a method for constructing a three-dimensional drainage device suitable for a loose filling slope is provided. The loose filling slope includes a stable stratum and a filling soil stratum above the stable stratum. The method includes: determining a maximum water inflow of the three-dimensional drainage device and numbers, distances and locations of a first collecting pipe, a second collecting pipe, a drainage gabion, a catchment canal and a drainage canal respectively; leveling the stable stratum and arranging one or more ladder grooves on the surface of the stable stratum; making one or more rectangular cages; wrapping the rectangular cage with geotextile outside and filling one or more stones in the rectangular cage; arranging the drainage gabions by placing the rectangular cage in the ladder groove and connecting the rectangular cages with each other in turn; wrapping the first collecting pipe with the geotextile outside and arranging the first collecting pipe in the filling soil stratum, where an end of the first collecting pipe connects with a filter packet and another end of the first collecting pipe connects with outside of earth surface; excavating one or more drainage canals and one or more catchment canals at a preset location on the surface of the slope and arranging the second collecting pipe, wherein the lower end of the second collecting pipe connects with the rectangular cage under the second collecting pipe and the upper end of the second collecting pipe connects with the catchment canal; and excavating a catchment ditch at a slope foot of the slope and a pool at the edge of the slope, and planting green plants on the surface of the slope.

Additional features will be set forth in part in the following description, and in part will become apparent to those people skilled in the art upon examination of the accompanying drawings or may be learned by production or operation of the examples. The features of the present disclosure may be realized and attained by practice or use of various aspects of the methodologies, instrumentalities and combinations set forth in the detailed examples discussed below.

BRIEF DESCRIPTION OF THE DRAWINGS

In order to more clearly illustrate the technical solutions of embodiments of the invention or the prior art, drawings will be used in the description of embodiments or the prior art will be given a brief description below. Apparently, the drawings in the following description only are some of embodiments of the invention, the ordinary skill in the art can obtain other drawings according to these illustrated drawings without creative effort.

Figure 1:
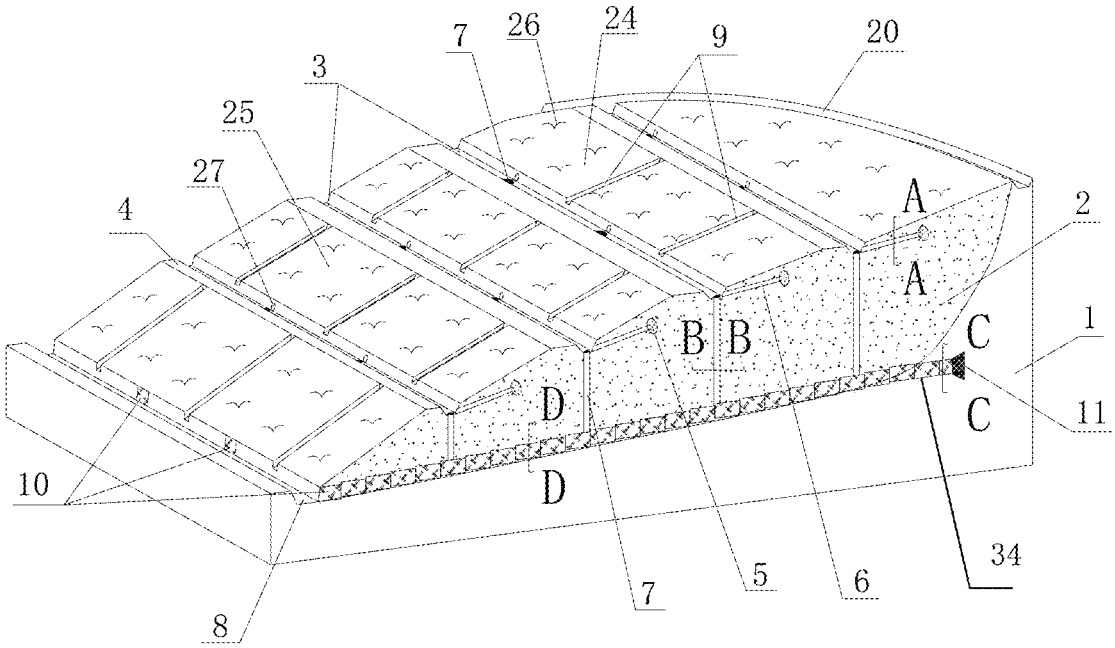
FIG. 1 is a schematic diagram of an exemplary three-dimensional drainage device suitable for a loose filling slope according to some embodiments of the present disclosure.

Wherein: 1-stable stratum, 2-filling soil stratum, 3-catchment canal, 4-platform, 5-filter packet, 6-first collecting pipe, 7-second collecting pipe, 8-catchment ditch, 9-drainage canal, 10-drainage gabion, 11-barb, 12-geotextile, 13-third layer, 14-ladder groove, 15-inner layer, 16-outer layer, 17-screen pack, 18-grouted rubble groove, 19-proof coating, 20-pool, 21-permeable hole, 22-stone, 23-rectangular cage, 24-slope section, 25-ditch grid, 26-green plant, 27-drain hole, 28-upper half pipe, 29-lower half pipe, 30-slope foot, 31-slope back, 32-first layer, 33-second layer, 34-mounting hole, 100-three-dimensional drainage device, 101-first part, 102-second part, 110-surface drainage mechanism, 120-shallow drainage mechanism, 130-deep drainage mechanism.

DETAILED DESCRIPTION OF THE PREFERRED EMBODIMENTS

In accordance with various implementations, as described in more detail below, mechanisms, which can include a three-dimensional drainage device suitable for a loose filling slope and a method for constructing the three-dimensional drainage device.

In the following detailed description, numerous specific details are set forth by the way of examples in order to provide a thorough understanding of the relevant disclosure. However, it should be apparent to those people skilled in the art that the present disclosure may be practiced without such details. In other instances, well known methods, procedures, systems, components, and/or circuitry have been described at a relatively high-level, without detail, in order to avoid unnecessarily obscuring aspects of the present disclosure.

Various modifications to the disclosed embodiments will be readily apparent to those people skilled in the art, and the general principles defined herein may be applied to other embodiments and applications without departing from the spirit and scope of the present disclosure. Thus, the present disclosure is not limited to the embodiments shown, but to be accorded the widest scope consistent with the claims.

It will be understood that the term "system", "unit", "sub-unit", "module", and/or "block" used herein are one method to distinguish different components, elements, parts, section or assembly of different level in ascending order. However, the terms may be displaced by other expression if they may achieve the same purpose.

It will be understood that when a unit, module or block is referred to as being "on", "connected to", or "coupled to" another unit, module, or block, it may be directly on, connected or coupled to the other unit, module, or block, or intervening unit, module, or block may be present, unless the context clearly indicates otherwise. As used herein, the term "and/or" includes any and all combinations of one or more of the associated listed items.

The terminology used herein is for the purpose of describing particular example embodiments only and is not intended to be limiting. As used herein, the singular forms "a", "an" and "the" may be intended to include the plural forms as well, unless the context clearly indicates otherwise. It will be further understood that the terms "comprise", "comprises", and/or "comprising", "include", "includes" and/or "including" when used in this specification, specify the presence of stated features, integers, steps, operations, elements, and/or components, but do not preclude the presence or addition of one or more other features, integers, steps, operations, elements, components, and/or groups thereof.

These and other features, and characteristics of the present disclosure, as well as the methods of operation and functions of the related elements of structure and the combination of parts and economies of manufacture, may become more apparent upon consideration of the following description with reference to the accompanying drawing(s), all of which form a part of this specification. It is to be expressly understood, however, that the drawing(s) are for the purpose of illustration and description only and are not intended to limit the scope of the present disclosure.

The present disclosure relates to the field of the slope drainage. Specially, the present disclosure relates to the three-dimensional drainage device suitable for the loose filling slope.

Figure 2:
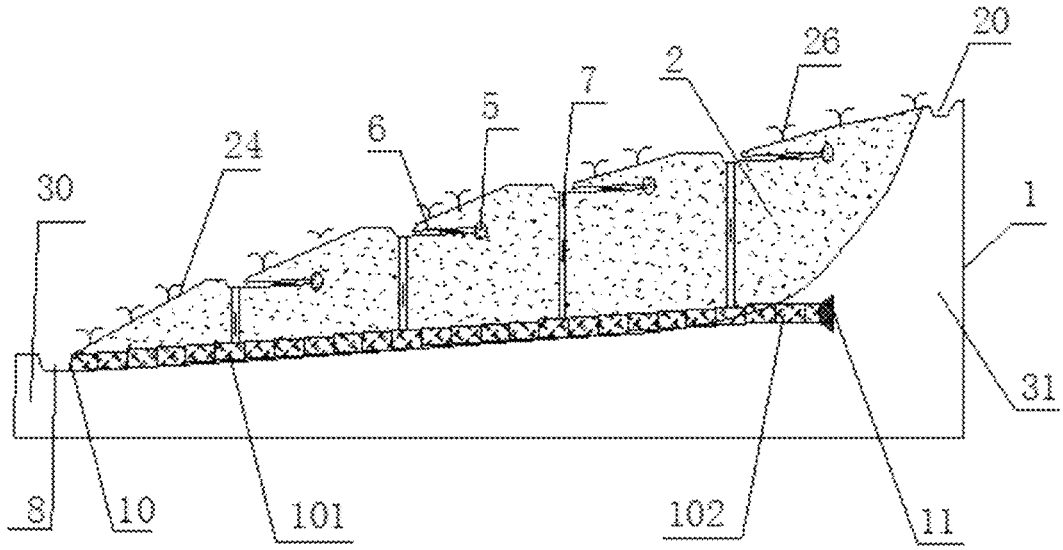
FIG. 2 is a section view of an exemplary three-dimensional drainage device suitable for the loose filling slope according to some embodiments of the present disclosure.
Figure 3:
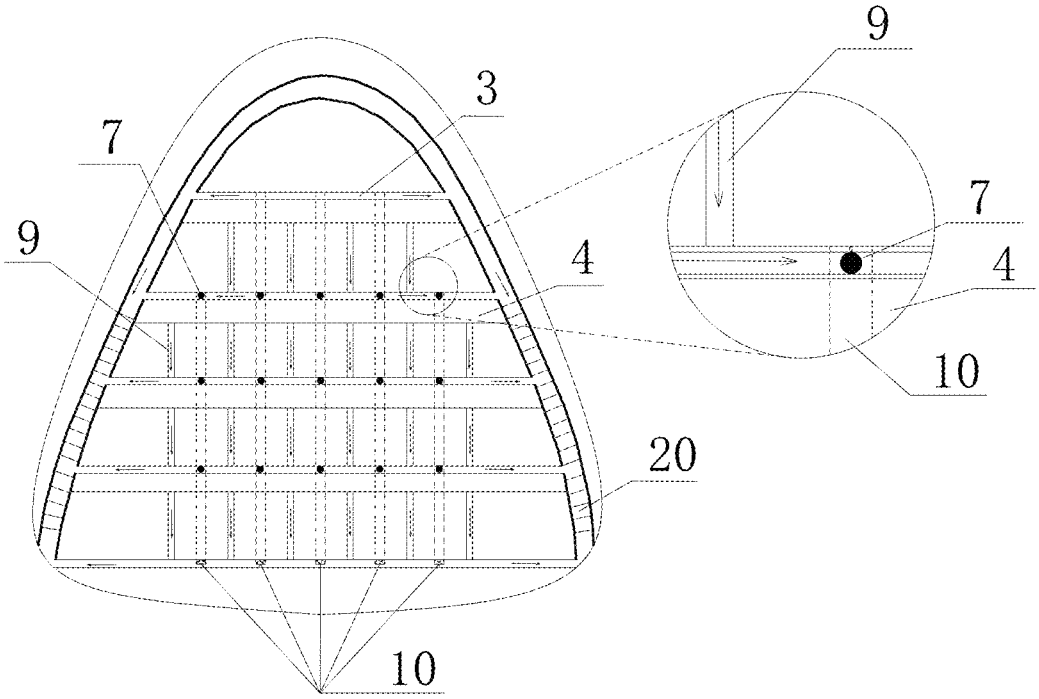
FIG. 3 is a top view of an exemplary three-dimensional drainage device suitable for the loose filling slope according to some embodiments of the present disclosure.
Figure 4:
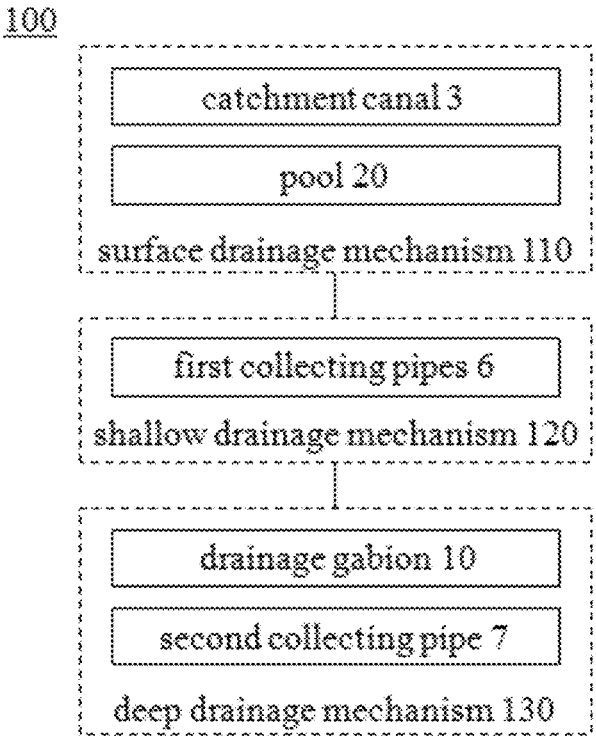
FIG. 4 is a schematic diagram of a composition of an exemplary three-dimensional drainage device suitable for a loose filling slope according to some embodiments of the present disclosure.

FIG. 1 is a schematic diagram of an exemplary three-dimensional drainage device suitable for the loose filling slope according to some embodiments of the present disclosure. FIG. 2 is a section view of an exemplary three-dimensional drainage device suitable for the loose filling slope according to some embodiments of the present disclosure. FIG. 3 is a top view of an exemplary three-dimensional drainage device suitable for the loose filling slope according to some embodiments of the present disclosure. FIG. 4 is a schematic diagram of a composition of an exemplary three-dimensional drainage device suitable for the loose filling slope according to some embodiments of the present disclosure. As shown in FIG. 1, FIG. 2 and FIG. 3, the slope may include a stable stratum 1 and a filling soil stratum 2 above the stable stratum 1. In some embodiments, the filling soil stratum 2 may be the loose filling slope.

As shown in FIG. 4, the three-dimensional drainage device 100 may include a surface drainage mechanism 110, a shallow drainage mechanism 120 and a deep drainage mechanism 130, and/or any other suitable component for drainage of the loose filling in accordance with various embodiments of the disclosure. The surface drainage mechanism 110 may include at one or more catchment canals 3 and a pool 20. The shallow drainage mechanism 120 may include one or more first collecting pipes 6. The deep drainage mechanism 130 may include one or more drainage gabions 10 and one or more second collecting pipes 7.

As shown in FIG. 1, FIG. 2 and FIG. 3, the pool 20 may be arranged on an edge of the filling soil stratum 2. In some embodiments, one side of the pool 20 near the edge of the filling soil stratum 2 may be provided with one or more steps, the steps may be configured to weaken impact of water to the pool 20. The catchment canal 3 may be arranged on an upper surface of the filling soil stratum 2. Each catchment canal 3 may be aligned along one contour of the slope and two ends of the catchment canal 3 may be both connected with the pool 20. The height differences between two adjacent contours are the same. In some embodiments, a cross-section of the catchment canal 3 may be an inverted trapezoid. The inverted trapezoid may be wide at top and narrow at bottom.

The catchment canals 3 may be distributed ladder-like along the upper surface of the filling soil stratum 2, and the filling soil stratum 2 may be divided into several slope sections 24 by the catchment canals 3. An upper edge of the slope section 24 may be provided with a platform 4. The platform 4 may be configured to reinforce the catchment canal 3.

The slope section 24 may be provided with one or more drainage canals 9. Two ends of the drainage canal 9 of the slope section 24 may be connected with the two catchment canals 3 at the upper end and the lower end of the slope section 24 respectively. In some embodiments, the two ends of the drainage canal 9 may be vertically connected with the two catchment canals 3 at the upper end and the lower end of the slope section 24 respectively. In some embodiments, the drainage canals 9 may be evenly distributed on the slope section 24, so that the slope section 24 may be divided into one or more ditch grids 25. Water gathered in the ditch grid 25 may aggregate to the catchment canal 3 along the two drainage canals 9 on both sides of the ditch grid 25. The water in the catchment canal 3 may aggregate to the pool 20 along the two ends of the catchment canal 3, so that the water gathered in the filling soil stratum 2 may be drained.

The bottom of the filling soil stratum 2 may be provided with a catchment ditch 8. The drainage canals 9 of the lowest slope section 24 may be connected with the catchment ditch 8. The lower end of the drainage gabion 10 may be connected with the catchment ditch 8. The water in the lowest slope section 24 and all drainage gabions 10 may flow into the catchment ditch 8 and may be drained from the catchment ditch 8. The pool 20 may connect the catchment ditch 8 and the water in the pool 20 may be drained from the catchment ditch 8.

The water in the catchment canals 3, the drainage canals 9 or the pools 20 from high to low may increase gradually. In some embodiments, the cross-sectional areas of the catchment canals 3 from high to low may increase in turn. In some embodiments, the cross-sectional areas of the drainage canals 9 from high to low may increase in turn. In some embodiments, the cross-sectional areas of the pools 20 from high to low may increase in turn. In some embodiments, one or more green plants 26 may be planted in the ditch grid 25. The green plants 26 may be configured to maintain water and soil and green the slope.

The catchment canal 3 may be provided with a drain hole 27. In some embodiments, the drain hole 27 may be set in a center of an upper side of the catchment canal 3. The drain hole 27 may extend upward to inside of the ditch grid 25 which may be above the catchment canal 3. The first collecting pipe 6 may be arranged in the drain hole 27. The first collecting pipe 6 may be wrapped with geotextile 12 outside. The upper end of the first collecting pipe 6 may be arranged at an orifice of the drain hole 27 and the lower end of the first collecting pipe 6 may be arranged at bottom of the drain hole 27. In some embodiments, the upper end of the first collecting pipe 6 may connect with a filter packet 5. The filter packet 5 may be configured to prevent sundries from the first collecting pipe 6. In some embodiments, the first collecting pipe 6 may be arranged in an inclined way, so that the water in the first collecting pipe 6 may run out.

Figure 5:
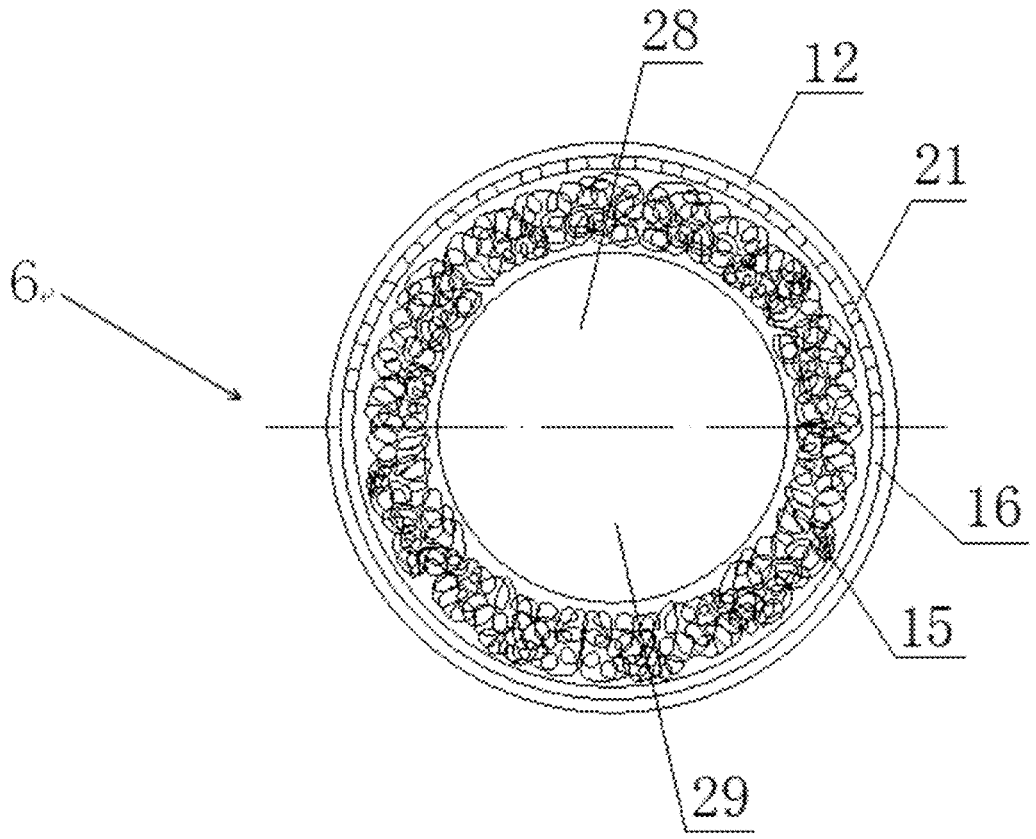
FIG. 5 is a section view of A-A in FIG. 1 according to some embodiments of the present disclosure.
Figure 6:
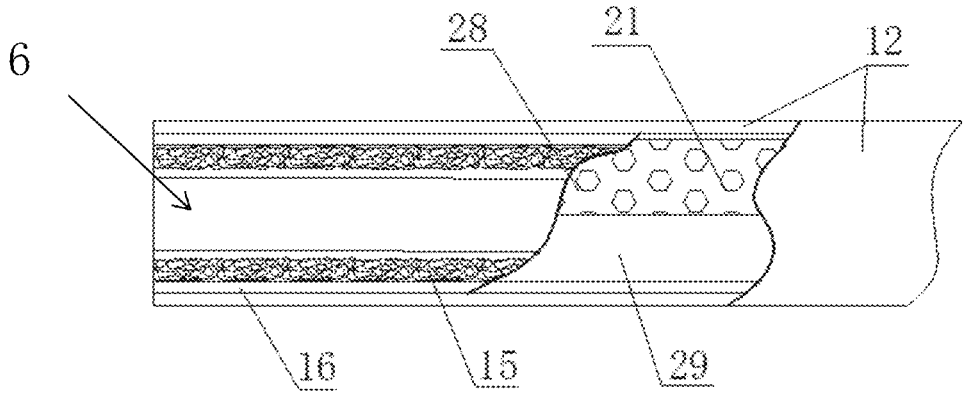
FIG. 6 is a schematic diagram of an exemplary first collecting pipe according to some embodiments of the present disclosure.

FIG. 5 is a section view of A-A in FIG. 1 according to some embodiments of the present disclosure. FIG. 6 is a schematic diagram of an exemplary first collecting pipe 6 according to some embodiments of the present disclosure. As illustrated, the first collecting pipe 6 may include an inner layer 15 and an outer layer 16. In some embodiments, the first collecting pipe 6 may be a semi-permeable PVC pipe. In some embodiments, the inner layer 15 may be a plastic-coated galvanized wire pipe and the outer layer 16 may be the PVC pipe. The plastic-coated galvanized wire pipe may be configured to support hole wall and filtrate. The first collecting pipe 6 may be divided into an upper half pipe 28 and a lower half pipe 29 along a center axis section of the first collecting pipe 6. An outer wall of the upper half pipe 28 may be provided with one or more permeable holes 21. In some embodiments, the permeable hole 21 may be a quincunx. The quincunx may increase a permeable area of the upper half pipe 28, so that the upper half pipe 28 of the first collecting pipe 6 may be permeable and the lower half pipe 29 of the first collecting pipe 6 may be impermeable. In other words, the upper part of the first collecting pipe 6 may be permeable and the lower part of the first collecting pipe 6 may be impermeable. The water in the filling soil stratum 2 may penetrate to the first collecting pipe 6 through the upper half pipe 28 and flow into the catchment canal 3 along the lower half pipe 29.

Figure 7:
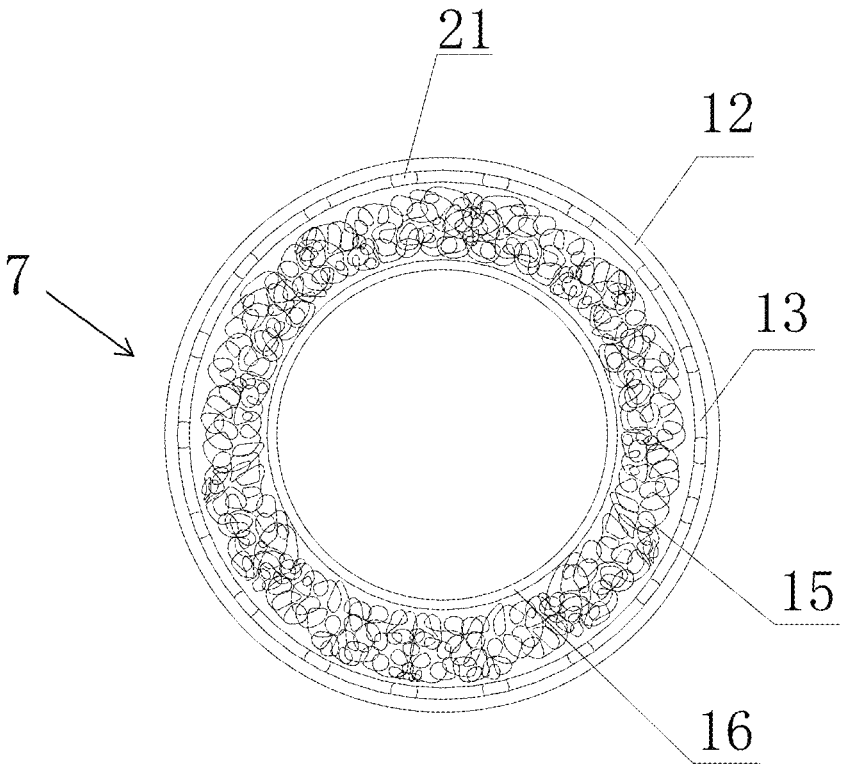
FIG. 7 is a section view of B-B in FIG. 1 according to some embodiments of the present disclosure.
Figure 8:
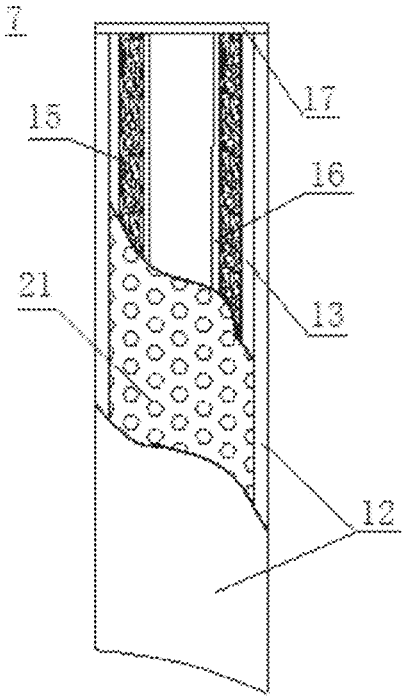
FIG. 8 is a schematic diagram of an exemplary second collecting pipe according to some embodiments of the present disclosure.

FIG. 7 is a section view of B-B in FIG. 1 according to some embodiments of the present disclosure. FIG. 8 is a schematic diagram of an exemplary second collecting pipe 7 according to some embodiments of the present disclosure. As illustrated, the second collecting pipe 7 may be set under the drain hole 27. The second collecting pipe 7 may go straight down. The upper pipe orifice of the second collecting pipe 7 may be provided with a filter 17. In some embodiments, the filter 17 may be provided with one or more meshed filtration pores.

The second collecting pipe 7 may include three pipe layers of a first layer 32, a second layer 33 and a third layer 13 in turn from inside to outside. The third layer 13 may be wrapped with the geotextile 12 outside. The first layer 32 may be impermeable, and the second layer 33 and the third layer 13 may be permeable. The second layer 33 may be configured to support the hole wall and filter. In some embodiments, the first layer 32 may be the PVC pipe, the second layer 33 may be the plastic-coated galvanized wire pipe and the third layer 13 may be the permeable PVC pipe.

The outer wall of the third layer 13 may be provided with one or more permeable holes 21. The permeable holes 21 may be evenly distributed on the outer wall of the third layer 13. In some embodiments, the permeable hole 21 may be the quincunx. The quincunx may increase the permeable area of the third layer 13. The water in the filling soil stratum 2 may penetrate to the second layer 32 through the third layer 13 and flow out along the first layer 32. The water in the first collecting pipe 6 may flow into the second collecting pipe 7 along the lower orifice of the first collecting pipe 6 and flow out along the first layer 32.

Figure 9:
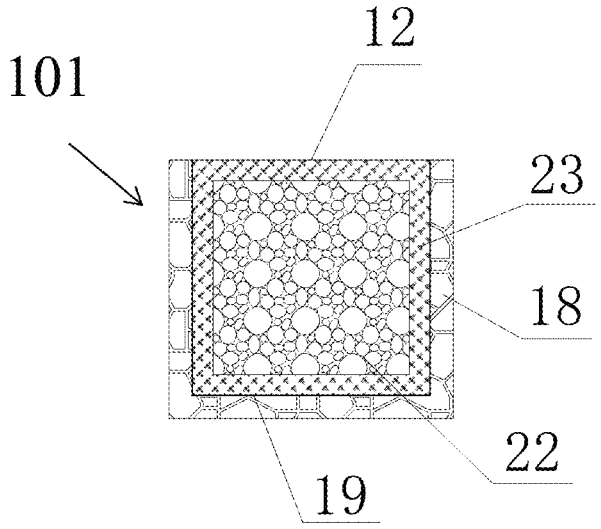
FIG. 9 is a section view of D-D in FIG. 1 according to some embodiments of the present disclosure.
Figure 10:
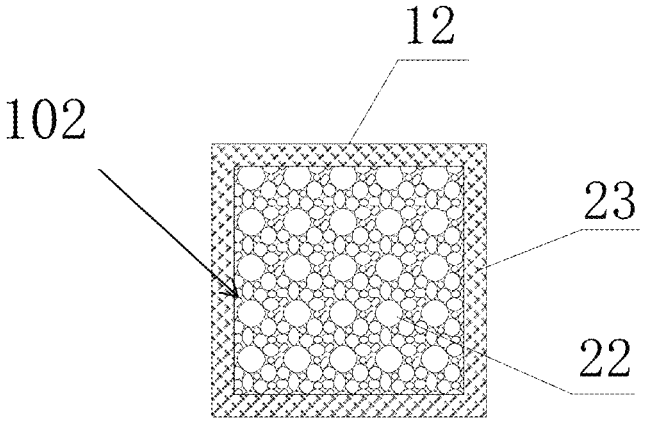
FIG. 10 is a section view of C-C in FIG. 1 according to some embodiments of the present disclosure.
Figure 11:
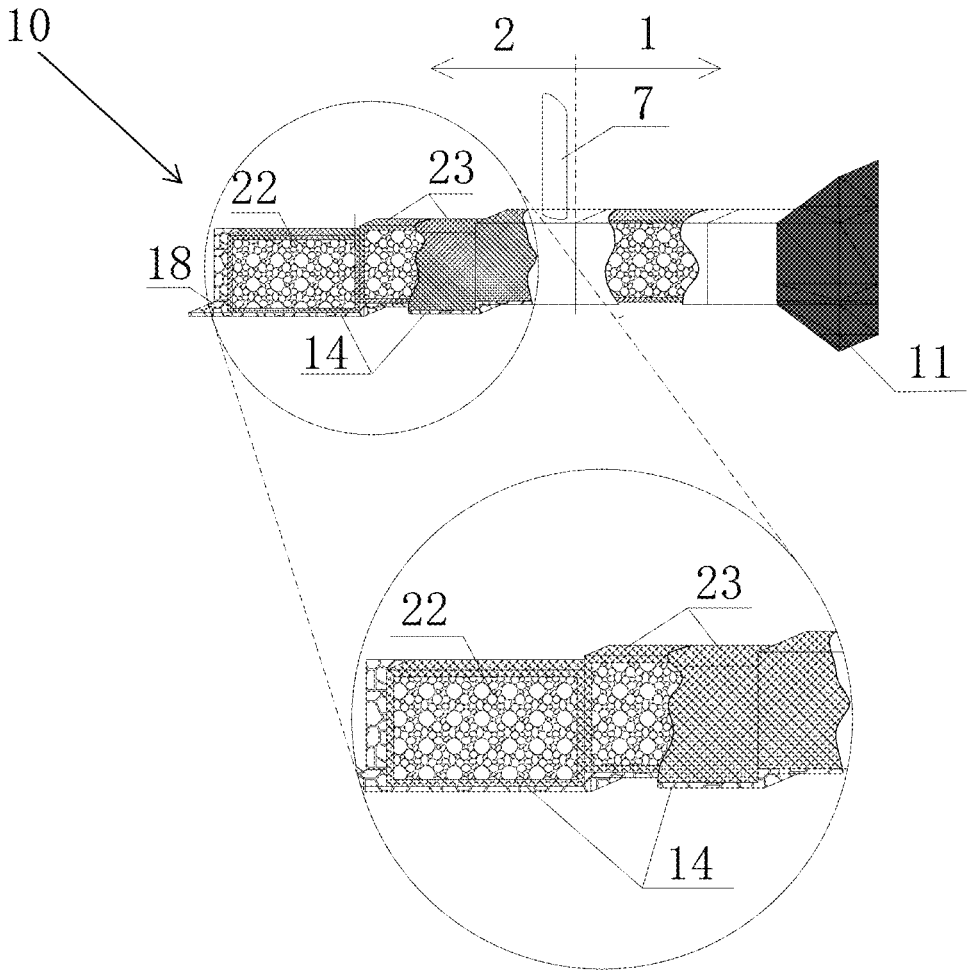
FIG. 11 is a schematic diagram of an exemplary drainage gabion according to some embodiments of the present disclosure.

FIG. 9 is a section view of D-D in FIG. 1 according to some embodiments of the present disclosure. FIG. 10 is a section view of C-C in FIG. 1 according to some embodiments of the present disclosure. FIG. 11 is a schematic diagram of an exemplary drainage gabion 10 according to some embodiments of the present disclosure. As illustrated, the drainage gabion 10 may include a first part 101 arranged in the filling soil stratum 2 and a second part 102 arranged in the stable stratum 1.

The first part 101 may include a grouted rubble groove 18. The grouted rubble groove 18 may include one or more ladder grooves 14. In some embodiments, the ladder groove 14 may be a U-shaped ladder groove. The ladder grooves 14 may be connected with each other in turn. The inner wall of the ladder groove 14 may be provided with a barrier coat 19. In some embodiments, the barrier coat 19 may be waterproof material. The ladder grooves 14 may be arranged upward in sequence from the slope foot 30 to the slope back 31, so that friction between the drainage gabion 10 and the slope may increase and it may have energy dissipation effect on the water in the drainage gabion 10. A rectangular cage 23 may be placed in the ladder groove 14. The rectangular cage 23 may be wrapped with geotextile 12 outside and be filled with one or more stones 22. In some embodiments, the rectangular cage 23 may be provided with one or more hooks, and two adjacent rectangular cages 23 may be connected with each other via the hooks.

The second part 102 may include one or more rectangular cages 23. The structure of the rectangular cage 23 of the second part 102 may be the same with the structure of the rectangular cage 23 of the first part 101. The rectangular cage 23 of the second part 102 located in the deepest part of the stable stratum 1 may be provided with a barb 11. The rectangular cage 23 may be embedded into the stable stratum 1 via the barb 11. The rectangular cage 23 may be wrapped with geotextile 12 outside and be filled with one or more stones 22. In some embodiments, the rectangular cage 23 may be provided with one or more hooks, and the two adjacent rectangular cages 23 may be connected with each other via the hooks. The rectangular cage 23 at the bottom of the second part 102 may be connected with the rectangular cage 23 at the top of the first part 101 via the hooks, so that the first part 101 and the second part 102 may be connected to form the drainage gabions 10.

A mounting hole 34 may be arranged inside the stable stratum 1. A depth of the mounting hole 34 may be determined according to the length of all drainage gabions 10, ensuring that the second part 102 embedded into the stable stratum 1 may provide a certain pulling force.

All drainage gabions 10 may be arranged side by side on the upper surface of the stable stratum 1. The lower end of the drainage gabion 10 may be arranged at a slope foot 30 of the slope. In some embodiments, the lower end of the drainage gabion 10 may be arranged at the center of the lower end side of the ditch grid 25 which may be at the bottom. The upper end of the drainage gabion 10 may be arranged in a slope back 31 of the slope. The slope foot 30 may be a front part of the stable stratum 1 and the slope back 31 may be a back part of the stable stratum 1, so that a trend direction of the drainage gabions 10 may have an obliquity to ensure the water be drained smoothly.

The lower end of the second collecting pipe 7 may be connected with the rectangular cage 23. The water in the first collecting pipe 6 and catchment canal 3 may flow into the first layer 32 of the second collecting pipe 7, and then flow into the rectangular cage 23. The deep water in the filling soil stratum 2 may penetrate to the second layer 33 of the second collecting pipe 7 and then flow into the rectangular cage 23 along the first layer 32 of the second collecting pipe 7 and may be drained via the grouted rubble groove 18. The number of the drainage gabions 10 and the number of the rectangular cages 23 in the drainage gabion 10 may be reasonably arranged according to some factors such as scale of the slope and underground water level.

Figure 12:
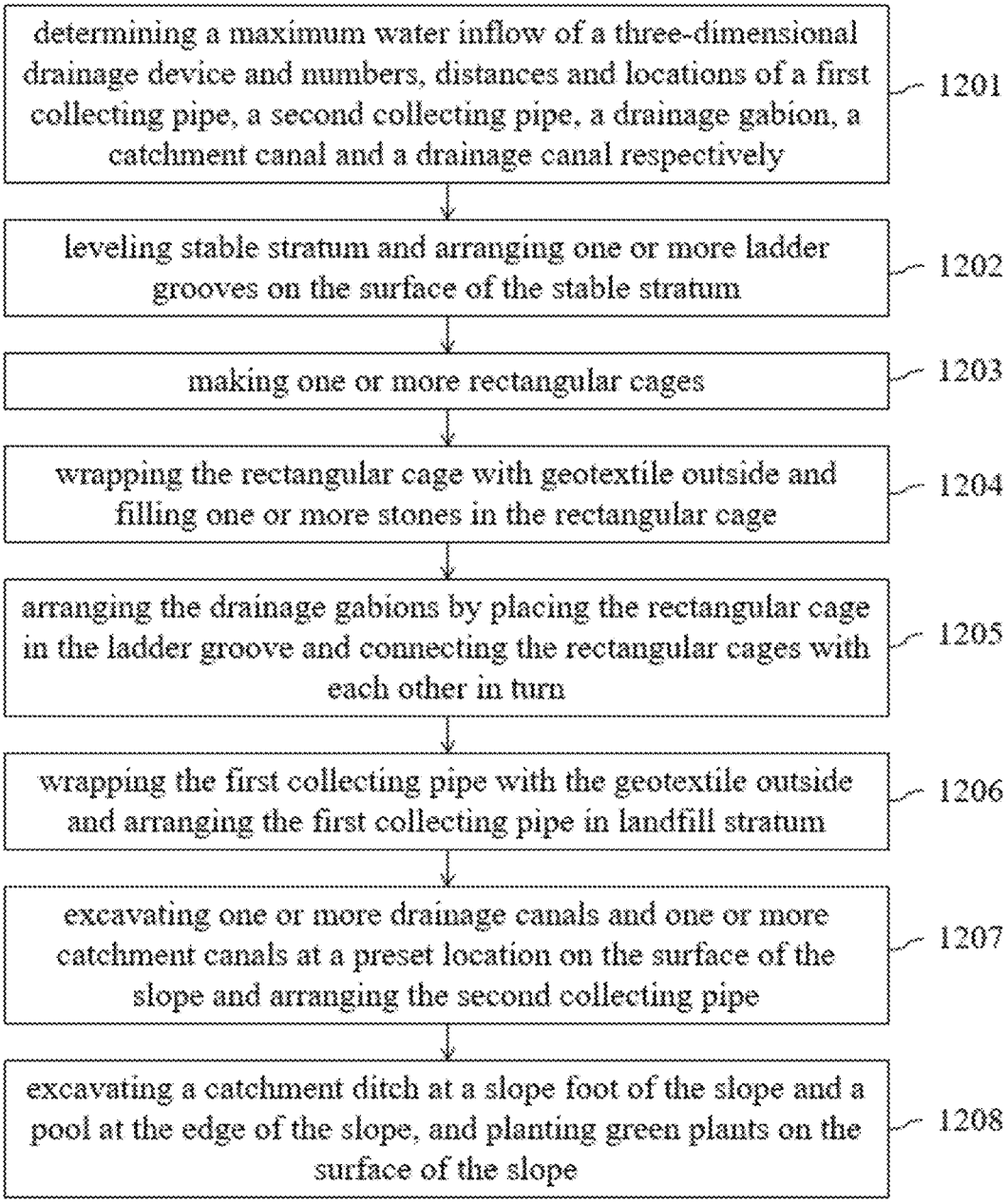
FIG. 12 is a flowchart illustrating an exemplary process/method for constructing the three-dimensional drainage device suitable for the loose filling slope according to some embodiments of the present disclosure.

FIG. 12 is a flowchart illustrating an exemplary process/method for constructing the three-dimensional drainage device suitable for the loose filling slope according to some embodiments of the present disclosure. The process and/or method may be executed by the response device of the state of the slip mass in the prefabricated magnetic field as exemplified in FIG. 1, FIG. 2, FIG. 3, FIG. 4, FIG. 5, FIG. 6, FIG. 7, FIG. 8, FIG. 9, FIG. 10, FIG. 11 and the description thereof. The operations of the illustrated process/method presented below are intended to be illustrative. In some embodiments, the process/method may be accomplished with one or more additional operations not described, and/or without one or more of the operations discussed. Additionally, the order in which the operations of the process/method as illustrated in FIG. 12 and described below is not intended to be limiting.

In step 1201, a maximum water inflow of the three-dimensional drainage device and the numbers, the distances and the locations of the first collecting pipe 6, the second collecting pipe 7, the drainage gabion 10, the catchment canal 3 and the drainage canal 9 may be determined respectively. In some embodiments, a volume and a specification of the filling soil stratum 2 may be designed based on a project. The maximum water inflow of the three-dimensional drainage device and the numbers, the distances and the locations of the first collecting pipe 6, the second collecting pipe 7, the drainage gabion 10, the catchment canal 3 and the drainage canal 9 may be determined based on the volume and the specification of the filling soil stratum 2 and other geological conditions such as rainfall.

In step 1202, the stable stratum 1 may be leveled and one or more ladder grooves 14 may be arranged on the surface of the stable stratum 1 as describe above.

In step 1203, one or more rectangular cages 23 may be made. The shape of the rectangular cage 23 may be the same as the internal shape of the ladder groove 14. In other words, a length, a width and a height of the rectangular cage 23 may the same as the length, the width and the height of the ladder groove 14.

In step 1204, the rectangular cage 23 may be wrapped with the geotextile 12 outside and be filled with one or more stones 22. Firstly, the rectangular cages 23 of the second part 102 may be arranged in the mounting hole 34, and the rectangular cages 23 may be connected with each other via the hooks in turn. The barb 11 of the rectangular cages 23 in the deepest of the stable stratum 1 may be embedded into the stable stratum 1. Secondly, concrete may be poured. Thirdly, the rectangular cage 23 may be arranged in each ladder groove 14 and the rectangular cages 23 may be connected with each other via the hooks in turn after the concrete has clotted. The all rectangular cages 23 may be connected to form a whole.

In step 1205, the drainage gabions 10 may be arranged in the way describe in step 1204. The drainage gabions 10 may not affect each other and may be arranged synchronously.

In step 1206, the first collecting pipe 6 may be wrapped with the geotextile 12 outside and be placed at the drain hole 27 when the filling soil stratum 2 has filled to the height of the drain hole 27. The end of the drain hole 27 that extends into the bottom of the filling soil stratum 2 may be embedded with the filter packet 5. The end of the first collecting pipe 6 may connect with the filter packet 5 and another end of the first collecting pipe 6 may connect with the outside of the earth surface. The end of the first collecting pipe 6 extends from the filling soil stratum 2 may be prevented from being blocked while filling of the filling soil stratum 2.

In step 1207, the drainage canal 9 and the catchment canal 3 may be excavated at a preset location on the surface of the slope and the second collecting pipe 7 may be arranged. The platform 4 may be built under the catchment canal 3. One or more holes may be drilled in the preset locations of the bottom of the catchment canal 3 and the second collecting pipe 7 may be arranged in the hole to make the lower end of the second collecting pipe 7 connect with the rectangular cage 23 under the second collecting pipe 7 and the upper end of the second collecting pipe 7 connect with the catchment canal 3.

In step 1208, the catchment ditch 8 may be excavated at the slope foot 30 of the slope and the pool 20 may be excavated at the edge of the slope, and the green plants 26 may be planted on the surface of the slope. The green plants 26 may be maintained regularly.

It should be noted that the above description is merely provided for the purposes of illustration, and not intended to limit the scope of the present disclosure. For persons having ordinary skills in the art, multiple variations and modifications may be made under the teachings of the present disclosure. However, those variations and modifications do not depart from the scope of the present disclosure. For example, one or more other optional steps may be added elsewhere in the exemplary process/method.

To implement various modules, units, and their functionalities described in the present disclosure, computer hardware platforms may be used as the hardware platform(s) for one or more of the elements described herein. A computer with user interface elements may be used to implement a personal computer (PC) or any other type of work station or terminal device. A computer may also act as a server if appropriately programmed.

Having thus described the basic concepts, it may be rather apparent to those people skilled in the art after reading this detailed disclosure that the foregoing detailed disclosure is intended to be presented by way of example only and is not limiting. Various alterations, improvements, and modifications may occur and are intended to those people skilled in the art, though not expressly stated herein. These alterations, improvements, and modifications are intended to be suggested by this disclosure, and are within the spirit and scope of the exemplary embodiments of this disclosure.

Moreover, certain terminology has been used to describe embodiments of the present disclosure. For example, the terms "one embodiment", "an embodiment" and/or "some embodiments" mean that a particular feature, structure or characteristic described in connection with the embodiment is included in at least one embodiment of the present disclosure. Therefore, it is emphasized and should be appreciated that two or more references to "an embodiment" or "one embodiment" or "an alternative embodiment" in various portions of this specification are not necessarily all referring to the same embodiment. Furthermore, the particular features, structures or characteristics may be combined as suitable in one or more embodiments of the present disclosure.

Further, it will be appreciated by one skilled in the art, aspects of the present disclosure may be illustrated and described herein in any of a number of patentable classes or context including any new and useful process, machine, manufacture, or composition of matter, or any new and useful improvement thereof. Accordingly, aspects of the present disclosure may be implemented entirely hardware, entirely software (including firmware, resident software, micro-code, etc.) or combining software and hardware implementation that may all generally be referred to herein as a "unit", "module" or "system". Furthermore, aspects of the present disclosure may take the form of a computer program product embodied in one or more computer readable media having computer readable program code embodied thereon.

A computer readable signal medium may include a propagated data signal with computer readable program code embodied therein, for example, in baseband or as part of a carrier wave. Such a propagated signal may take any of a variety of forms, including electro-magnetic, optical, or the like, or any suitable combination thereof. A computer readable signal medium may be any computer readable medium that is not a computer readable storage medium and that may communicate, propagate, or transport a program for use by or in connection with an instruction execution system, apparatus, or device. Program code embodied on a computer readable signal medium may be transmitted using any appropriate medium, including wireless, wireline, optical fiber cable, RF, or the like, or any suitable combination of the foregoing.

Computer program code for carrying out operations for aspects of the present disclosure may be written in any combination of one or more programming languages, including an object-oriented programming language such as Java, Scala, Smalltalk, Eiffel, JADE, Emerald, C++, C #, VB. NET, Python or the like, conventional procedural programming languages, such as the "C" programming language, Visual Basic, Fortran 2003, Perl, COBOL 2002, PHP, ABAP, dynamic programming languages such as Python, Ruby and Groovy, or other programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider) or in a cloud computing environment or offered as a service such as a Software as a Service (SaaS).

Furthermore, the recited order of processing elements or sequences, or the use of numbers, letters, or other designations therefore, is not intended to limit the claimed processes and methods to any order except as may be specified in the claims. Although the above disclosure discusses through various examples what is currently considered to be a variety of useful embodiments of the disclosure, it is to be understood that such detail is solely for that purpose, and that the appended claims are not limited to the disclosed embodiments, but, on the contrary, are intended to cover modifications and equivalent arrangements that are within the spirit and scope of the disclosed embodiments. For example, although the implementation of various components described above may be embodied in a hardware device, it may also be implemented as a software only solution, e.g., an installation on an existing server or mobile device.

Similarly, it should be appreciated that in the foregoing description of embodiments of the present disclosure, various features are sometimes grouped together in a single embodiment, figure, or description thereof for the purpose of streamlining the disclosure aiding in the understanding of one or more of the various embodiments. This method of disclosure, however, is not to be interpreted as reflecting an intention that the claimed subject matter requires more features than are expressly recited in each claim. Rather, claimed subject matter may lie in less than all features of a single foregoing disclosed embodiment.

What is claimed is:

1. A three-dimensional drainage device suitable for a loose filling slope, wherein the loose filling slope comprises a stable stratum and a filling soil stratum above the stable stratum, and bottom of the filling soil stratum is provided with a catchment ditch; the three-dimensional drainage device comprising:

a surface drainage mechanism, comprising two catchment canals arranged on an upper surface of the filling soil stratum and a pool arranged on an edge of the filling soil stratum, and the pool is connected with the catchment ditch, wherein two ends of each of the two catchment canals connect with the pool; a drainage canal is arranged between the two catchment canals, wherein two ends of the drainage canal connect with the two catchment canals and the drainage canal is connected with the catchment ditch;

a shallow drainage mechanism, comprising two first collecting pipes, each of two first collecting pipes is arranged on an upper side of one of the two catchment canals, wherein an upper end of each of the two first collecting pipes is provided with a filter packet and is buried in the filling soil stratum, and a lower end of each of the two first collecting pipes connects with one of the two catchment canals; and a deep drainage mechanism, comprising one or more drainage gabions and two second collecting pipes, wherein the one or more drainage gabions are arranged side by side on the upper surface of the stable stratum, wherein an upper end of each of the two second collecting pipes is connected with the one of the two catchment canals and an lower end of each of the two second collecting pipes is connected with the one or more drainage gabions, and the one or more drainage gabions are connected with the catchment ditch.

2. The three-dimensional drainage device of claim 1, wherein one side of the pool near the edge of the filling soil stratum is provided with one or more steps configured to weaken impact of water to the pool.

3. The three-dimensional drainage device of claim 1, wherein each catchment canal is aligned along one contour of the loose filling slope and height differences between two adjacent contours are the same.

4. The three-dimensional drainage device of claim 1, wherein a cross-section of each catchment canal is an inverted trapezoid.

5. The three-dimensional drainage device of claim 1, wherein the two catchment canals are distributed along the upper surface of the filling soil stratum and the filling soil stratum is divided into several slope sections by the two catchment canals.

6. The three-dimensional drainage device of claim 5, wherein an upper edge of each slope sections is provided with a platform configured to reinforce the one of the two catchment canals.

7. The three-dimensional drainage device of claim 5, wherein each slope section is provided with the drainage canals and the slope section is divided into two ditch grids by the drainage canal.

8. The three-dimensional drainage device of claim 7, wherein two ends of the drainage canal are connected with the two catchment canals at the upper end and the lower end of the slope section respectively.

9. The three-dimensional drainage device of claim 8, wherein the two ends of the drainage canal are vertically connected with the two catchment canals at the upper end and the lower end of the slope section respectively.

10. The three-dimensional drainage device of claim 5, wherein the drainage canal is connected with the catchment ditch and water in the lowest slope section flow into the catchment ditch.

11. The three-dimensional drainage device of claim 1, wherein cross-sectional areas of the two catchment canals from high to low increase in turn, the cross-sectional areas of the drainage canals from high to low increase in turn and the cross-sectional areas of the pools from high to low increase in turn.

12. The three-dimensional drainage device of claim 1, wherein one of the two catchment canals is provided with a drain hole and one of the two first collecting pipes is arranged in the drain hole.

13. The three-dimensional drainage device of claim 1, wherein each of the two first collecting pipes is wrapped with geotextile outside.

14. The three-dimensional drainage device of claim 1, wherein each of the two first collecting pipes comprises an inner layer and an outer layer, the inner layer is a plastic-coated galvanized wire pipe and the outer layer is a PVC pipe.

15. The three-dimensional drainage device of claim 1, wherein each of the two first collecting pipes is divided into an upper half pipe and a lower half pipe along a center axis section of the corresponding first collecting pipe, the upper half pipe is permeable and the lower half pipe is impermeable.

16. The three-dimensional drainage device of claim 1, wherein each of the two second collecting pipes comprises three pipe layers of a first layer, a second layer and a third layer in turn from inside to outside, the first layer is a PVC pipe, the second layer is a plastic-coated galvanized wire pipe and the third layer is a permeable PVC pipe.

17. The three-dimensional drainage device of claim 1, wherein each of the one or more drainage gabions comprises a grouted rubble groove; the grouted rubble groove comprises one or more ladder grooves, and the one or more ladder grooves are connected with each other in turn; and a rectangular cage connected with the lower end of each of the two second collecting pipes is placed in the one or more ladder grooves, and water in the one or more drainage gabions flow into the catchment ditch.

18. The three-dimensional drainage device of claim 17, wherein inner wall of each of the one or more ladder grooves is provided with a barrier coat, the rectangular cage is wrapped with geotextile outside and is filled with one or more stones, the rectangular cage is provided with one or more hooks, and two adjacent rectangular cages are connected with each other via the one or more hooks.

* * * * *